US005233933A

United States Patent [19]

McSorley et al.

[11] Patent Number: 5,233,933

[45] Date of Patent: Aug. 10, 1993

[54] METHOD OF REDUCING TRANSIENT EMISSIONS FROM ROTARY KILN INCINERATORS AND CONTAINER FOR ATTAINING THE SAME

[75] Inventors: Joseph A. McSorley; Paul M. Lemieux, both of Cary; William P. Linak, Apex; Ronald W. Lowans, Durham, all of N.C.; Jost O. L. Wendt, Tucson, Ariz.

[73] Assignee: The United States of America as represented by the Administrator of the Environmental Protection Agency, Washington, D.C.

[21] Appl. No.: 969,554

[22] Filed: Oct. 30, 1992

Related U.S. Application Data

[63] Continuation of Ser. No. 673,913, Mar. 25, 1991, abandoned.

[51] Int. Cl.[5] ..... F23G 7/04

[52] U.S. Cl. ..... 110/246; 220/506; 110/346

[58] Field of Search ..... 220/506; 110/246, 346

[56] References Cited

U.S. PATENT DOCUMENTS

| | | | |
|---|---|---|---|
| 2,096,825 | 10/1937 | Roman | 220/506 |
| 4,627,595 | 12/1986 | Rhodes et al. | 220/506 |
| 4,762,224 | 8/1988 | Hall | 220/506 |
| 4,850,290 | 7/1989 | Benoit et al. | 110/246 |
| 4,969,407 | 11/1990 | Benoit et al. | 110/346 |
| 5,058,513 | 10/1991 | Benoit et al. | 110/246 |

OTHER PUBLICATIONS

Linak et al., *On the Occurrence of Transient Puffs in a Rotary Kiln Incinerator Simulator,* I. "Prototype Solid Plastic Wastes", copyright 1987-APCA, pp. 54-65.

Wendt et al., "Prediction of Transient Behavior During Batch Incineration of Liquid Wastes in Rotary Kilns," *Hazardous Waste & Hazardous Materials,* vol. 7, No. 1, 1990, pp. 41-54.

Wendt et al., "Mechanisms Governing Transients from the Batch Incineration of Liquid Wastes in Rotary Kilns," *Combustion Science and Technology,* 1988, vol. 61, pp. 169-185.

Lemieux et al., "Development of a Simple Indicator for Measuring the Performance of Incinerators, Industrial Furnaces, and Boilers Burning Hazardous Waste," presented at AWMA International Specialty Conference, Waste Combustion in Boilers and Industrial Furnaces, Kansas City, Mo., Apr. 17-20, 1990.

Lemieux et al., "Minimization of Transient Emissions from Rotary Kiln Incinerators," submitted to *Combustion Science and Technology,* Aug. 2, 1989, revised Jan. 5, 1990.

Linak et al., *On the Occurrence of Transient Puffs in a Rotary Kiln Incinerator Simulator,* II. "Contained Liquid Wastes on Sorbent", copyright 1987-APCA, pp. 934-942.

Fabian et al., "How Bayer Incinerates Wastes," *Hydrocarbon Processing,* Apr. 1979, pp. 183-192.

Frankel et al., "Survey of the Incinerator Manufacturing Industry," CEP Mar. 1983, pp. 44-55.

*Primary Examiner*—Henry C. Yuen

*Attorney, Agent, or Firm*—Lowe, Price, LeBlanc & Becker

[57] ABSTRACT

Organic liquid-like hazardous waste is loaded with a sorbent in a container including interior and exterior compartments. The container is supplied to a rotary incinerating kiln. The waste is loaded in the container and the compartments are arranged so that the waste in the exterior compartment is initially vaporized in the kiln without the waste in the interior compartment mixing and being vaporized with the waste in the exterior compartment. The waste in the exterior compartment acts initially as a thermal and mass transfer barrier to prevent initial vaporization in the kiln of the waste in the interior compartment to substantially delay the vaporization of the waste in the interior compartment relative the vaporization time of waste in the exterior compartment and relative to the time when the waste in the interior compartment would have been vaporized if the container did not include the compartments.

5 Claims, 4 Drawing Sheets

Fig. 5
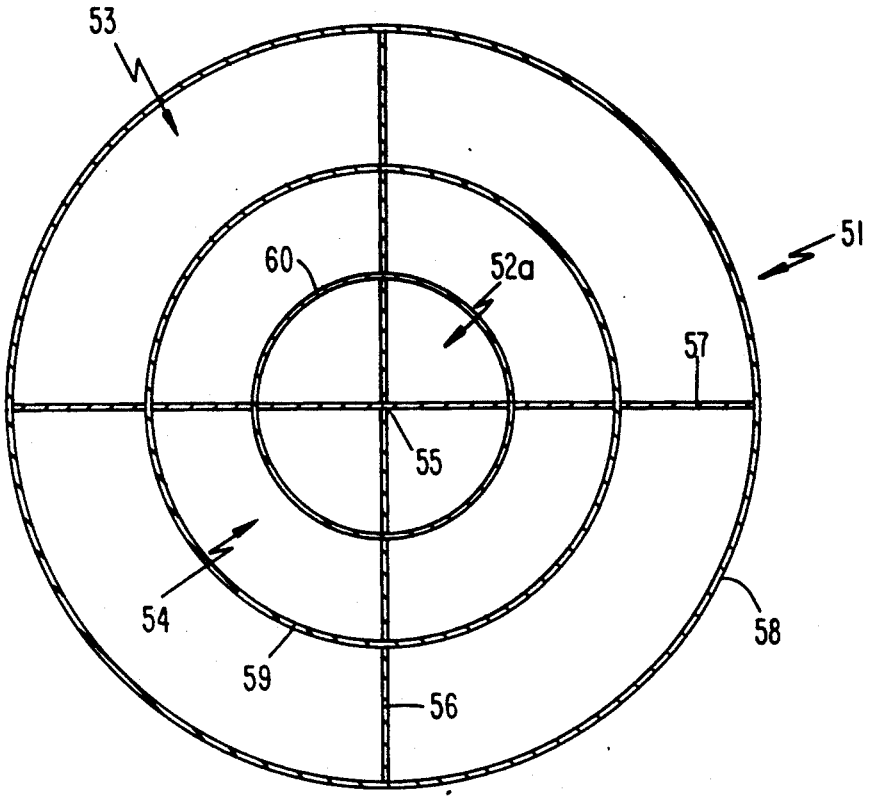
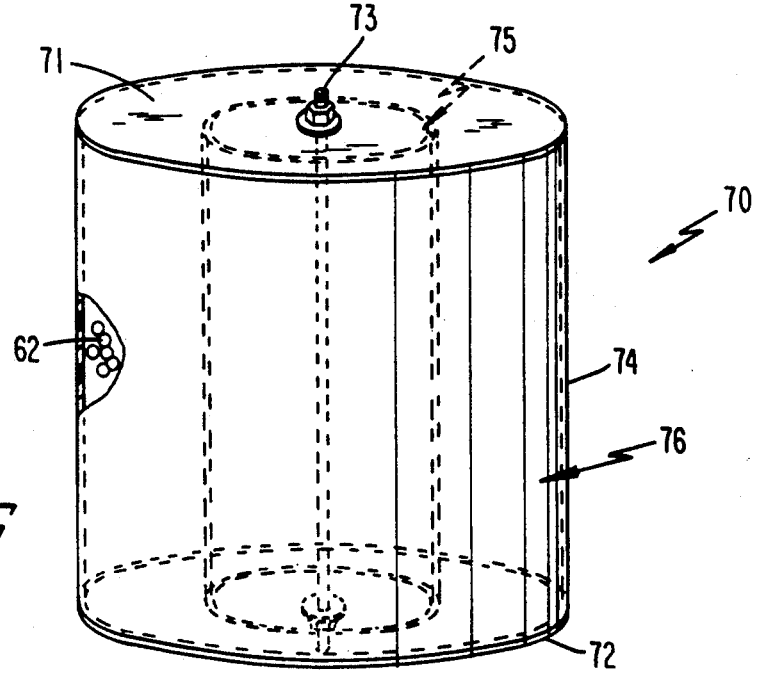
Fig. 6

METHOD OF REDUCING TRANSIENT EMISSIONS FROM ROTARY KILN INCINERATORS AND CONTAINER FOR ATTAINING THE SAME

This is a continuation of copending application Ser. No. 07/673,913 filed on Mar. 25, 1991, abandoned.

FIELD OF INVENTION

The present invention relates generally to disposing of organic liquid-like hazardous waste in incinerating rotary kilns and more particularly to a method wherein the waste is poured into interior and exterior compartments within a container that is incinerated by such a kiln, and to a container having interior and exterior compartments filled with the hazardous waste.

BACKGROUND ART

Rotary incinerating kilns are used for disposing of organic liquid-like hazardous waste. Typically, some such kilns are batch fed and have a fuel and/or waste fired primary flame in a region close to an inlet where containers filled with the hazardous material are loaded into the kiln. The kiln includes a rotating cylinder having a generally horizontal axis, with a diameter of 10 to 20 feet and a length to diameter ratio of about 3 or 4 to 1. The cylinder axis is tilted downwardly by a few degrees so that the hazardous waste is transported by gravity and kiln rotation from the inlet to an outlet of the kiln. The cylinder is rotated at slow speed, such as one revolution in five minutes. Typically, the total residence time of solid materials resulting from incineration of the hazardous waste in the kiln is about a half hour. The containerized hazardous waste is typically loaded into drums ranging in size from 1 to 55-gallons. The use of smaller containers has the disadvantage of increased hazardous waste handling by personnel loading and handling the containers. The hazardous waste containers are periodically supplied to the kiln at a relatively low rate. Typically, only a small cross section of the kiln is occupied by the hazardous waste and its residue, on the order of 1-2 percent. Waste feed rate is also limited by the heating valve of the waste in each drum.

The contents of a drum containing the hazardous waste and possibly a sorbent, such as ground corn cobs, sawdust or vermiculite, are usually volatilized during a period extending from the first seconds to few minutes of residence time of the drum and waste in the kiln. Residue of the waste and the drum are further incinerated and decomposed to form ash.

A transient phenomenon involving heat transfer into and waste mass transfer out of the waste promotes rapid release of waste vapor into the gas phase environment of the kiln. This rapid vapor release depletes and displaces excess oxygen from the primary flame to cause formation of a "puff" of incompletely or partially incinerated waste comprising undestroyed principal organic hazardous constituents, products of incomplete combustion and organic particulates, i.e., soot. If these components of the puff cannot be destroyed by an afterburner responsive to gases flowing out of the kiln or isolated by pollution control devices downstream of the kiln, there may result a temporary failure of an incinerator system of which the rotary kiln is a part.

Our research has shown that these "puffs" are caused by the rapid release of waste material into the gas phase. This waste quickly consumes the available oxygen in the kiln, to diminish or terminate oxidation even though sufficient temperatures and residence times are maintained. Thus it has been found that considerable amounts of incompletely incinerated hazardous waste can escape from the rotary kiln each time a drum filled with hazardous waste is supplied to the rotary kiln. Obviously, it is undesirable for such unincinerated hazardous waste to be emitted into the atmosphere.

It is, accordingly, an object of the present invention to provide a new and improved method of incinerating hazardous organic liquid-like waste.

Another object of the invention is to provide a new and improved container for liquid-like, organic hazardous waste, wherein the container is constructed to enable the waste to be more completely incinerated in a rotary kiln.

A further object of the invention is to provide a new and improved method of supplying liquid-like organic hazardous waste to a rotary kiln used to incinerate the waste wherein there is a substantial reduction of transient gaseous emissions resulting from unincinerated hazardous waste.

Still another object of the invention is to provide a new and improved method of supplying liquidlike organic hazardous waste to a rotary kiln used to incinerate the waste so that the time required to volatilize or vaporize the waste is substantially increased, thereby to enable more complete incineration of the waste and reduce the amount of hazardous materials emitted by an incinerator system.

A further object of the invention is to provide a new and improved container for liquid-like organic hazardous waste to be used with a rotary incinerator kiln, wherein the container is constructed to substantially reduce transient gaseous emissions resulting from unincinerated or partially incinerated hazardous waste.

THE INVENTION

In accordance with one aspect of the present invention organic liquid-like hazardous waste is disposed of by pouring the waste into a container including interior and exterior compartments. The container including the waste is loaded into an operating rotary incinerating kiln that incinerates the container and waste. The waste is loaded into the container and the compartments are arranged so that the waste in an exterior compartment is initially vaporized in the kiln without the waste in the interior compartment mixing and being vaporized with the waste in the exterior compartment. The waste in the exterior compartment acts initially as a thermal and/or mass transfer barrier to prevent initial vaporization of the waste in the interior compartment. There is thus a substantial delay in the vaporization of the waste in the interior compartment relative to the vaporization time of waste in the exterior compartment and relative to the time when the waste in the interior compartment would have been vaporized if the container did not include the compartments.

In accordance with another feature of the present invention, interior and exterior compartments of a container are loaded with organic liquid-like hazardous waste. The waste is loaded into the container and the compartments are arranged so that the waste in the exterior compartment is initially vaporized in a rotary kiln without the waste in the interior compartment mixing and being vaporized with the waste in the exterior compartment. The waste in the exterior compartment acts initially as a thermal and/or mass transfer barrier to prevent initial vaporization in the kiln of the waste in the interior compartment and to substantially delay the vaporization of the waste in the interior compartment relative to the vaporization time of waste in the exterior compartment and relative to the time when the waste in the interior compartment would have been vaporized if the container did not include the compartment. Preferably, the waste is bound on a sorbent in the compartments.

In a preferred embodiment the container includes plural interior subcompartments to provide greater thermal and/or mass transfer isolation between the waste in the interior and exterior compartments. Also, the container is preferably configured as a cylinder including cylindrical exterior and interior walls. The plural subchambers are achieved by partitioning the interior and exterior chambers into sectors by axially extending panels or walls that extend diametrically across the interior and exterior chambers.

End faces of the container could be constructed to have a longer incineration time in the kiln than the exterior wall to assist in delaying vaporization of the waste from the interior chamber. In one embodiment, the container includes plural cylindrical interior walls having differing diameters.

An aspect of the invention concerns a container for holding organic liquid-like hazardous waste, wherein the container is constructed to enable the waste to be substantially completely incinerated in a rotary kiln without the production of large puffs of incompletely incinerated waste. The container includes a cylindrical outer wall surrounding a cylindrical inner wall to form interior and exterior compartments. End faces abut against the walls. Axially and radially extending partitions extend diametrically through the container between the end faces. The partitions and inner wall divide the container into plural interior and exterior waste receiving subcompartments. The subcompartments are arranged so that the waste in an exterior subcompartment is initially vaporized in the kiln without the waste in the interior compartments mixing and being vaporized with the waste in the exterior compartments. The waste in the exterior compartments acts initially as a thermal and/or mass transfer barrier to prevent initial vaporization in the kiln of the waste in the interior compartments and to substantially delay the vaporization of the waste in the interior compartments relative to the vaporization time of waste in the exterior compartments and relative to the time when the waste in the interior compartments would have been vaporized if the container did not include the compartments.

The above and still further objects, features and advantages of the present invention will become apparent upon consideration of the following detailed description of several specific embodiments thereof, especially when taken in conjunction with the accompanying drawings.

BRIEF DESCRIPTION OF DRAWING

FIG. 5 is a top view of another embodiment of a container in accordance with the invention; and FIG. 6 is a side view of an additional embodiment of a container in accordance with the invention.

DETAILED DESCRIPTION OF DRAWING

Figure 1:
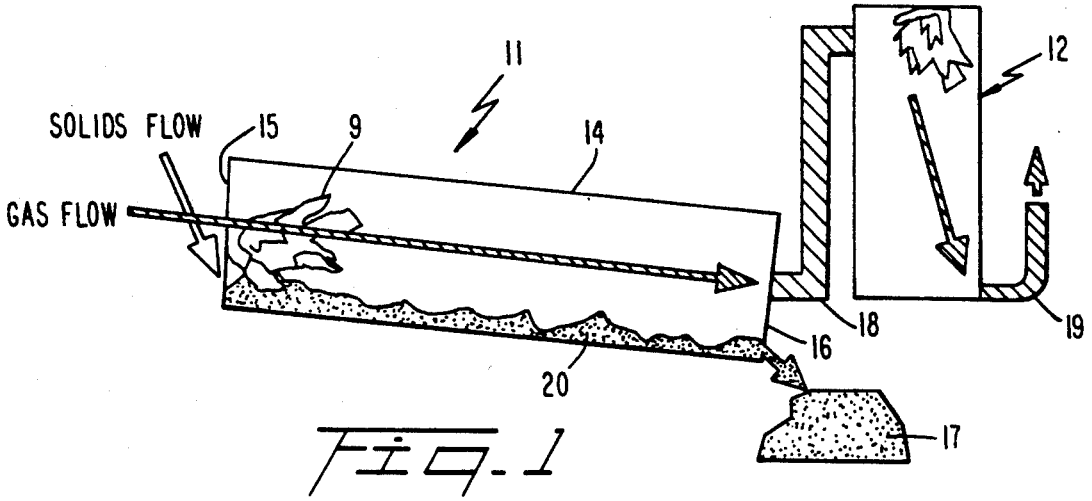
FIG. 1 is a schematic view of a typical prior art rotary kiln of the type with which the present invention is used.

Reference is now made to FIG. 1 of the drawing, a schematic diagram of a portion of a typical prior art incinerator system including rotary kiln 11 and afterburner 12. Rotary kiln 11 includes cylinder 14 having a generally horizontal axis that is inclined slightly downwardly between cylinder inlet end 15 and outlet end 16. At inlet end 15 is primary flame source 9. Hazardous organic liquid-like waste in containers is supplied to inlet 15. The waste, containers and sorbent for the waste in the containers are incinerated in cylinder 14 to produce combustion products and solids that flow to outlet end 16.

Typically, cylinder 14 has a diameter of 10 to 20 feet and a length to diameter ratio of about 3-4 to 1. Cylinder 14 is turned about its longitudinal axis at a rate of about one cycle in five minutes. The usual resident time of solid material in cylinder 14 is about 30 to 35 minutes. Typically, the cross sectional area of cylinder 14 occupied by solids is approximately 1 to 2%. The containers of hazardous material are from time to time or periodically supplied to inlet 15. For liquid-like hazardous organic waste, which is itself a fuel for the primary flame of source 9, the combustion products in the cylinder are typically 80% nitrogen, 10% oxygen, 5% carbon dioxide, the balance being water vapor and trace components. The hazardous, organic liquid-like waste, the container in which it is located and a sorbent (e.g., ground corn cobs, sawdust or vermiculite) in the container for the waste are burned to form the combustion products, as well as ash residue 20 that generally sits on the lowest surfaces of the wall of cylinder 14. Each container, when initially introduced into cylinder 14, quickly rolls onto its sidewall, which is made of metal, plastic or plastic coated cardboard. The sidewall is quickly consumed, followed by vaporization and combustion of the hazardous waste and the sorbent. The ash residue flows by gravity and kiln rotation from inlet end 15 to outlet end 16 and into bottom ash receiver 17. The gaseous combustion products and fly ash flow from outlet end 16 to afterburner 12 through conduit 18. The gaseous products and fly ash are further burned in afterburner 12 and ultimately emitted to the atmosphere, after passing through conduit 19 and other pollution control processors.

In the prior art, when drums of liquid-like (the term "liquid-like" is used in the specification and claims to denote a material that is a liquid or a solid that can be poured in a manner similar to a liquid), organic hazardous waste are applied to inlet 15, there is usually a transient gas puff, having a duration of several minutes, in conduit 18. The transient gas puff results from depletion and displacement of excess oxygen from flame source 9 and includes undestroyed principal organic hazardous constituents, products of incomplete combustion and organic particulate matter, i.e., soot or ash. If these species are not destroyed by afterburner 12 or captured by pollution control devices downstream of the afterburner, they basically cause a temporary failure of the incinerator system, such that hazardous gases are released to the atmosphere.

Previously, attempts were made to control puffs by "rule of thumb" practices that incinerator operators incorporated into their activities, basically through experience and know-how. It has been shown that this is far from an optimum approach.

It has also been found that when the hazardous waste is packaged into steel drums, there is a potential for explosions if bung openings (the two normally capped holes in the top of a 55-gallon drum) are not opened to relieve pressures. Research we have conducted also has shown that plastic drums add significantly to the amount of material in emitted puffs because such drums have high heating values. Coated cardboard drums, however, add little additional mass to the transient puff but are quickly consumed and thereby permit the hazardous waste therein to form short duration puffs having significant amounts of incompletely incinerated hazardous waste.

In accordance with the present invention, the containers for the hazardous waste are configured in such a manner as to increase the time for the organic hazardous liquid-like waste to be converted into gaseous form, i.e., to decrease the rate at which the hazardous waste is transferred from a liquid-like or sorbed condition in the sorbent in the container to the gas phase. By increasing the time required to transfer the hazardous waste from the liquid-like or sorbed condition to the gaseous phase, the kiln environment is not overwhelmed by vaporizing organic hazardous material. Excess oxygen provided by the steady state burners comprising flame source 9 is then better able to keep up with the transient nature of the load. By decreasing the rate at which the hazardous waste is transferred from the liquid-like or sorbed condition to the gas phase, there is no significant effect on the quality of ash 20 because of the long residence time of the solids in cylinder 14.

Figure 2:
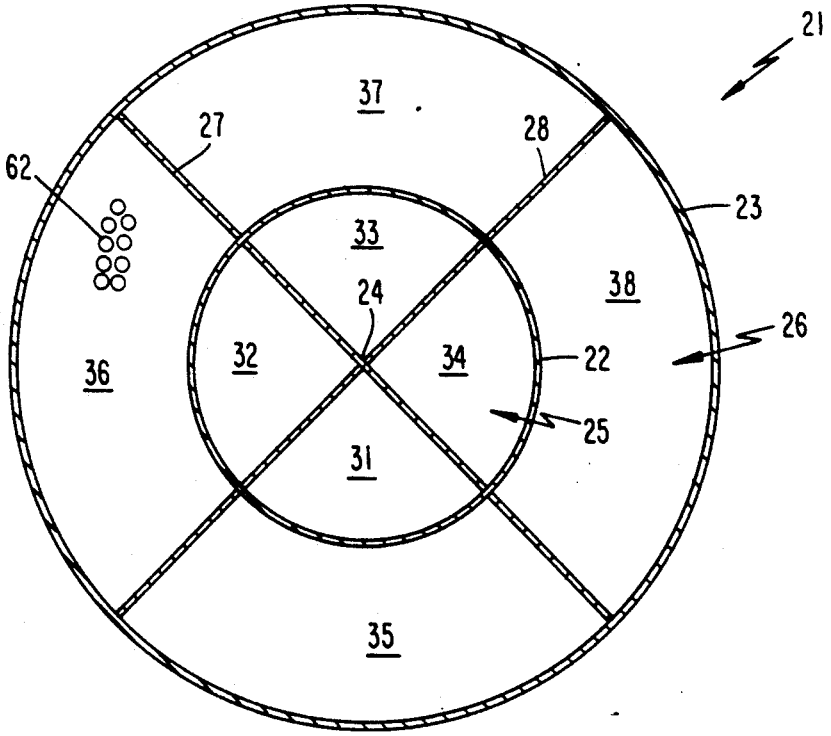
FIG. 2 is a top cross sectional view of a container in accordance with a preferred embodiment of the present invention.
Figure 3:
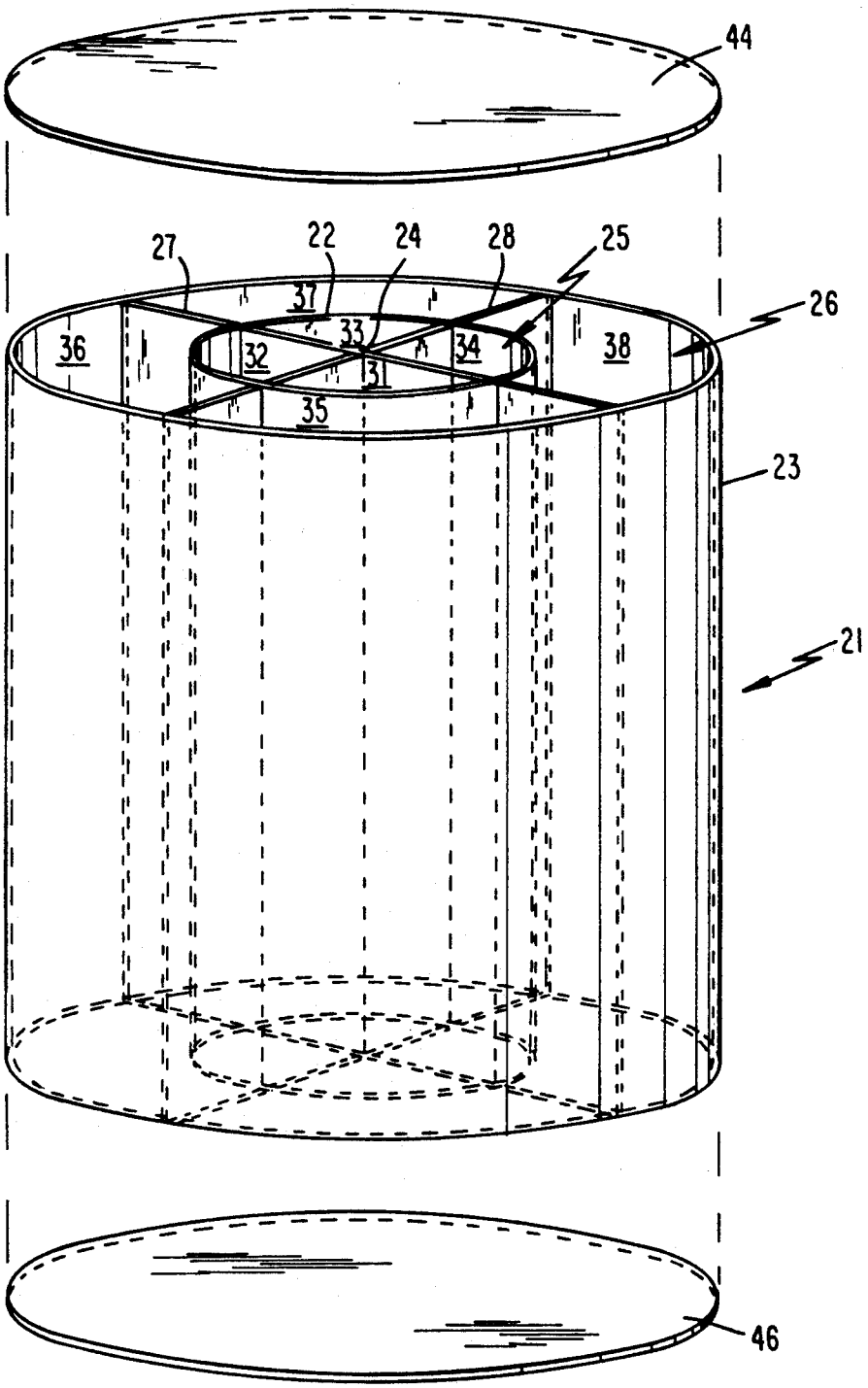
FIG. 3 is a perspective, partially exploded view of the container illustrated in FIG. 2.
Figure 4:
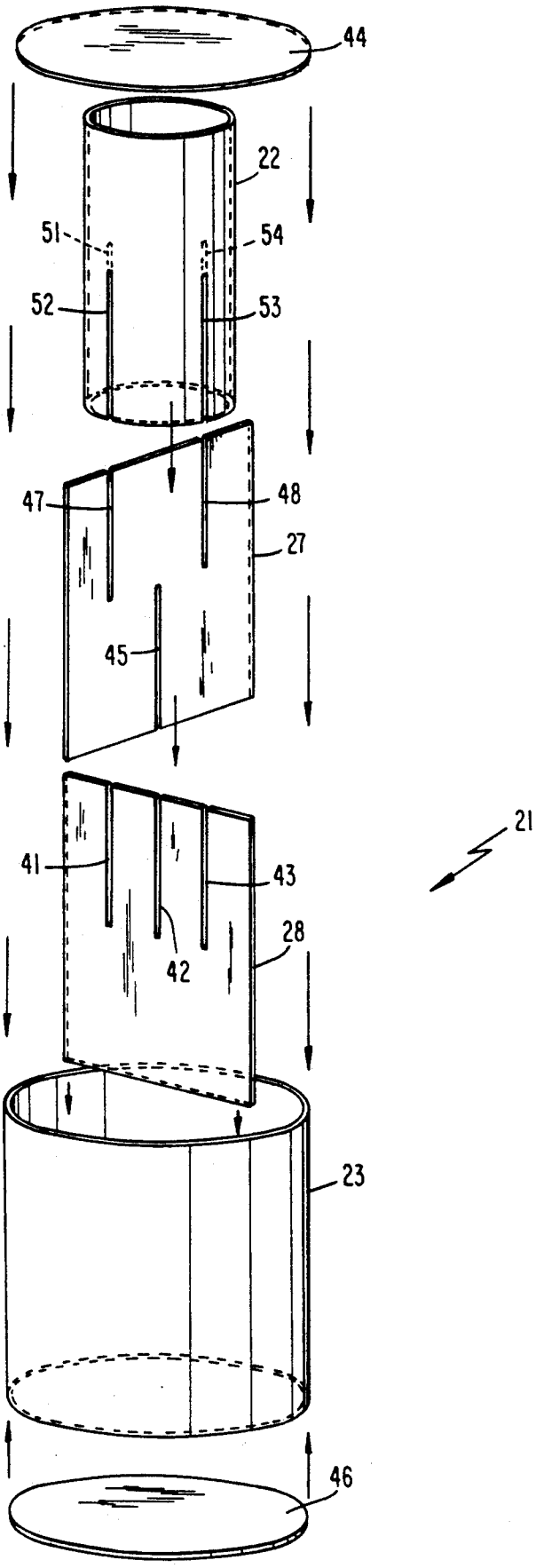
FIG. 4 is an exploded view of the container illustrated in FIGS. 2 and 3.

A preferred embodiment of a container in accordance with the invention is illustrated in FIGS. 2, 3 and 4 as cylindrical drum 21. Container or drum 21 includes interior and exterior cylindrical sidewalls 22 and 23, coaxial with container longitudinal axis 24. Cylindrical sidewalls 22 and 23 divide container 21 into interior and exterior compartments 25 and 26. Each of compartments 25 and 26 is subdivided into four additional subcompartments by a pair of radially extending rectangular panels 27 and 28 which are at right angles to each other. Thereby, subcompartments 31–34 of compartment 25 are, in cross section, configured as sectors of a circle having equal areas and the same shape. Subcompartments 35–38 of compartment 26 are configured as sectors of an annulus, such that each sector has the same interior and exterior radii, equal area and the perimeter of each sector subtends an angle of 90° .

As illustrated in FIG. 4, rectangular panels 27 and 28 and interior sidewall 22 include axially extending slots 41–43, 45, 47, 48 and 51–54 to enable the panels to intersect each other at right angles and to nest in sidewalls 22 and 23. Each of panels 27 and 28 has the same length, equal to the identical lengths of cylindrical sidewalls 22 and 23. The ends of rectangular panels 27 and 28 are thereby coplanar with the end faces of cylindrical walls 22 and 23.

Each of slots 41–43, 45, 47, 48 and 51-54 has a length equal to one half the length of sidewalls 22 and 23. Slots 41, 42 and 43 of panel 28 extend from the same edge of panel 28 that abuts against a first end cap 44 of container 21, with slot 42 being coincident with axis 24 and slots 41 and 43 being equispaced from slot 42 by a distance equal to the radius of inner cylindrical wall 22. Panel 27 includes central slot 45, coincident with axis 24, and extending from the end of the panel which abuts against second end cap 46 of container 21. Slots 46 and 47 extend from opposite ends of panel 27, abutting against end cap 44. Slots 47 and 48 are equispaced from axis 24 by a distance equal to the radius of cylindrical sidewall 22. Sidewall 22 includes slots 51–54 that extend parallel to axis 24 from the end of sidewall 22 that abuts against end cap 46. Slots 51–54 are spaced 90° from each other around the circular perimeter of interior sidewall 22.

Panel 27 is inserted into cylindrical interior sidewall 22 so that (1) slots 47 and 48 fit into and are aligned with diametrically opposed slots 51 and 53, (2) slots 42 and 45 interfit with each other and (3) slots 41 and 43 interfit with diametrically opposed slots 52 and 54. After panels 27 and 28 have been secured to interior cylindrical wall 22, the resulting assembly is dropped into exterior cylindrical wall 23 to form interior and exterior compartments 25 and 26, as well as sub-compartments 31–34 and 35–38. The axially extending edges of panels 27 and 28 engage the interior face of exterior wall 23 to effectively separate subcompartments 35–38 from each other. Similarly, the engagement of panels 27 and 28 with each other and wall 22 is such that interior subcompartments 31–34 are isolated from each other. Since the edges of panels 27 and 28 abut against end caps 44 and 46 when the end caps are secured to container 21, the various subcompartments are isolated from each other. In the preferred embodiment of FIGS. 2–4, each subcompartment has the same volume to minimize transient puffs.

Each of interior and exterior sidewalls 22 and 23, panels 27 and 28 and end caps 44 and 46 is, in one embodiment, formed of cardboard coated with a conventional material, usually a plastic; all of these cardboard pieces usually have the same burning characteristics. Alternatively, end caps 44 and 46 are made of thicker cardboard or thin metal so the sidewalls 22 and 23 rupture before the end caps. By making end caps 44 and 46 of thicker coated cardboard or thin metal, greater isolation is provided between inner and outer compartments 22 and 23.

In accordance with a further embodiment, as illustrated in cross section in FIG. 5, container 51 is configured to include interior compartment **52*a*, exterior compartment 53 and intermediate compartment 54, located between the interior and exterior compartments. All of compartments 52*a*–54 have a common longitudinal axis 55. Each of compartments 52*a*–54 is divided into four subcompartments by panels 56 and 57 which are at right angles to each other and extend through axis 55 between the interior faces of sidewall 58 that defines the exterior of compartment 53 and container 51. A circular boundary between compartments 53 and 54 is established by cylindrical sidewall 59, while a circular boundary between interior and intermediate compartments 52*a* and 54 is established by cylindrical sidewall 60. Each of sidewalls 58–60 is coaxial with axis 55. Container 51 is provided with end caps, as discussed supra with regard to end caps 44 and 46 for container 21**.

After a container, such as container 21, has been assembled, sorbent 62 for the hazardous pourable, liquid-like organic waste is poured into each of the subchambers to be sorbed by sorbent 62; to simplify the drawing, only a portion of sorbent 62 is illustrated in FIG. 2. (Hereafter the description of operation is given with regard to container 21 but it is to be understood that similar mechanisms occur for container 51.) With axis 24 of container 21 vertically oriented and end cap 44 secured in situ against wall 23 and the bottom face of the container, the hazardous waste is poured into the container. Then, the remaining end cap 46 is secured to the open, top end face of container 41.

Container 21, after being filled with sorbent 62 and hazardous liquid-like organic waste and sealed, is loaded into inlet 15 of cylinder 14 of rotary kiln 11.

The subcompartment or subcompartments in compartment 26 of container 21 directly below the upper portion of sidewall 23 may begin to burn sooner than any of the other subcompartments. Because of interior sidewall 22 and panels 27 and 28 the contents of the various subcompartments do not initially intermix with each other. Once a subcompartment of exterior compartment 26 has ruptured, heat transfer resistances and the latent heat of vaporization of the vaporizing waste insulate the adjoining interior subcompartment of interior compartment 25. As time progresses, additional subcompartments in outer compartment 26 rupture and the contents of these exterior subcompartments vaporize in a time-delayed manner.

After sorbent and hazardous waste in outer compartment 26 has been vaporized, sufficient heat is transferred through interior wall 22 to the sorbent and hazardous organic waste in interior compartment 25. Hazardous waste in interior compartment 25 then burns through and is released as additional vapor. The result is that instead of one large puff in which the entire hazardous waste in a container is vaporized within a short period of time, multiple smaller, more completely combusted puffs are produced over a longer time period. The excess oxygen from flame source 9 is better able to handle the multiple smaller puffs than a large single puff. Hence, there is considerably greater combustion of the hazardous waste material and destruction thereof, so that the amount of incompletely or partially incinerated waste material discharged to the atmosphere is considerably reduced. In initial tests utilizing the configuration generally illustrated in FIGS. 2–4, it was found that there was an approximate 75% reduction of potentially harmful emissions.

An additional advantage of the present invention is that greater throughputs are achievable while still reducing emissions. In the prior art, to prevent an excessive amount of material in the transient puffs the amount of waste charged in each container was limited. Hence, there was relatively low incinerator utilization because of the low rate at which different containers are supplied to inlet 15.

In another embodiment of the invention illustrated in FIG. 6, container 70 is arranged to include end caps 71 and 72 secured to each other by connecting the end caps to rod 73 that extends through the container along the container axis. End caps 71 and 72 remain in situ even after exterior side wall 74 has been ruptured. In FIG. 6, the diametrically extending panels of FIGS. 2–5 are eliminated and small diameter drum 75 is placed inside large diameter drum 76 of about the same length as the small drum. Drums 75 and 76 are approximately coaxial with rod 73 that extends up through drum 75 from outside of end cap 72. Initially, drums 75 and 76 were filled with sorbent and the hazardous waste with one of the end caps, e.g., end cap 71, in situ. Then, the other end cap 72 is secured to filled container 70 by connecting the end cap to rod 73. The ends of rod 73 may be threaded and the end caps secured in place with nut and washer arrangements.

End caps 71 and 72 are preferably made of a material that does not rupture as easily as outside wall 74. Further, end caps 61 and 62 remain in situ during combustion of the walls of drums 75 and 76 so that the flame in cylinder 14 does not vaporize the waste contacting the end caps in the compartment defined by drum 75 until most, if not all, of the waste in the volume between the walls of drums 75 and 76 is vaporized. For example, end caps 71 and 72 are metal and wall 74 is plastic-coated cardboard, as is the wall of drum 75. Thereby, an effective thermal and mass transfer barrier is provided for the waste in the compartments defined by drums 75 and 76.

While there have been described and illustrated several specific embodiments of the invention, it will be clear that variations in the details of the embodiments specifically illustrated and described may be made without departing from the true spirit and scope of the invention as defined in the appended claims. For example, an end cap arrangement similar to that of FIG. 6 can be incorporated in FIGS. 2–5. In addition, a large container that completely encloses several complete smaller containers can be employed, rather than a single multi-compartmented container.

We claim:

1. A method of disposing of liquid-like hazardous waste comprising the steps of:

pouring the waste into a container including interior and exterior compartments, loading the container including the waste into an operating rotary incinerating kiln that incinerates containers of waste, operating the incinerator at a temperature that vaporizes waste in the exterior compartment of the container without the waste in the interior compartment of the container being initially mixed and vaporized with the waste in the exterior compartment, the waste in the exterior compartment initially acting as a thermal barrier to delay vaporization in the kiln of waste in the interior compartment relative to vaporization of the waste in the exterior compartment, and continuing to operate the incinerator at a temperature that begins to incinerate waste in the interior compartment after a substantial portion of the waste in the exterior compartment has been vaporized.

2. The method of claim 1 wherein the waste is sorbed by a sorbent in the container prior to the container being loaded into the kiln.

3. The method of claim 1 wherein the waste is loaded into the container and the compartments are arranged so that the waste in the exterior compartment acts initially as a mass transfer barrier to prevent initial vaporization in the kiln of the waste in the interior compartment to delay substantially the vaporization of the waste in the interior compartment relative to vaporization time of waste in the exterior compartment and relative to the time when the waste in the interior compartment would have been vaporized if the container did not include the compartments.

4. The method of claim 3 wherein the volume of waste loaded into said interior container compartment is substantially the same as the volume of waste loaded into said exterior container compartment.

5. A method of disposing of liquid-like hazardous waste comprising the steps of:

pouring the waste into a container including interior, intermediate and exterior compartments, loading the container including the waste into an operating rotary incinerating kiln that incinerates containers of waste, operating the incinerator at a temperature that vaporizes waste in the exterior compartment of the container without the waste in the interior and intermediate compartments of the container being initially mixed and vaporized with the waste in the exterior compartment, the waste in the exterior compartment initially acting as a thermal barrier to delay vaporization in the kiln of waste in the interior and intermediate compartments relative to vaporization of the waste in the exterior compartment, continuing to operate the incinerator at a temperature that begins to incinerate waste in the intermediate compartment after a substantial portion of the waste in the exterior compartment has been vaporized and that vaporizes waste in the intermediate compartment of the container without the waste in the interior compartment of the container being initially mixed and vaporized with the waste in the intermediate compartment, the waste in the intermediate compartment initially acting as a thermal barrier to delay vaporization in the kiln of waste in the interior compartment relative to vaporization of the waste in the intermediate compartment, continuing to operate the incinerator at a temperature that begins to incinerate waste in the interior compartment after a substantial portion of the waste in the exterior and intermediate compartments has been vaporized.

* * * * *